United States Patent [19]

Yoneyama

[11] Patent Number: 4,630,827

[45] Date of Patent: Dec. 23, 1986

[54] GOLF CLUB HEAD

[75] Inventor: Minoru Yoneyama, Niigata, Japan

[73] Assignee: Yonex Kabushiki Kaisha, Niigata, Japan

[21] Appl. No.: 713,742

[22] Filed: Mar. 19, 1985

[30] Foreign Application Priority Data

Mar. 19, 1984 [JP] Japan ..... 59-38138

[51] Int. Cl.[4] ..... A63B 53/04

[52] U.S. Cl. ..... 273/169; 273/173; 273/167 J

[58] Field of Search ..... 273/168, 171, 78, 169, 273/170, 80.1, 173, 174, 167 F, 167 J

[56] References Cited

U.S. PATENT DOCUMENTS

| | | | |
|---|---|---|---|
| 2,530,446 | 11/1950 | Beardsley | 273/168 X |
| 3,025,061 | 3/1962 | Ernst et al. | 273/82 |
| 3,220,733 | 11/1965 | Saleeby | 273/171 |
| 4,506,888 | 3/1985 | Nardozzi | 273/168 X |
| 4,534,558 | 8/1985 | Yoneyama | 273/78 |

FOREIGN PATENT DOCUMENTS

| | | | |
|---|---|---|---|
| 692197 | 8/1964 | Canada | 273/167 R |

OTHER PUBLICATIONS

Yonex, "Carbonex 22", Golf Digest, 12/83 issue, p. 47.

*Primary Examiner*—George J. Marlo
*Attorney, Agent, or Firm*—Wenderoth, Lind & Ponack

[57] ABSTRACT

A golf club head includes a sole of metal material and having a rib on the upper surface thereof, the rib extending from a heel portion to a toe portion along the longitudinal direction of the sole. A hitting portion formed of carbon fiber reinforced resin material and having a substantially triangular shape in cross section is mounted on the sole and fixed thereto with the rib being fitted within the hitting portion. The hitting portion occupies an area of from 70 to 85% of the total area of the cross section of the head body substantially at the longitudinal center thereof. A hosel for receiving a shaft therein is integrally connected to the sole at the heel portion.

6 Claims, 2 Drawing Figures

GOLF CLUB HEAD

BACKGROUND OF THE INVENTION

The present invention relates to the head structure of golf clubs and, more particularly, to an improvement in the head structure of iron clubs.

In general, iron clubs are intended primarily for second, third and bunker shots rather than tee shots, and they are used often for hitting shots from the bare ground, a sandy place and so on as well as from turf. Accordingly, conventional iron clubs are designed so that the club head is made in one body from a metallic material such as soft iron, stainless steel or the like in order to prevent the club head, and in particular its sole, from being readily damaged by a pebble or sand when hitting a ball.

The metal material, however, does not permit variety in the design of such clubs because of its large specific gravity. For example, it is desirable particularly for beginners and powerless golfers that the center of gravity of the head is located at a relatively lower part thereof. This is achieved by increasing the thickness of the lower part of the head including the sole thereof, but the thickness of middle and upper portions of the head should be reduced in order to maintain the weight of the head at a standard level, such reduced thickness resulting in the defect of decreased hitting distance of a ball hit by the club. Thus, it has been believed for conventional iron clubs that the good operability and high performance are not compatible with each other. Further, the face surface of the conventional head is made of a hard metal, and hence its repulsive force is small. Accordingly, the use of hard metal is not always preferable from the viewpoints of the direction and distance of a ball hit by the club.

SUMMARY OF THE INVENTION

It is therefore an object of the present invention to provide a golf club head which will permit variety in design thereof so as to achieve simultaneously both good operability and high performance.

Another object of the present invention is to provide a golf club head which can increase the hitting distance of a golf ball with stable direction.

A further object of the present invention is the provision of a golf club head which is so tough as to prevent damage thereto when it is used to hit a ball on bare ground or in a bunker.

According to the invention, a golf club head includes a sole formed of metal material and a rib formed on an upper surface of the sole integrally therewith, the rib extending from a heel portion to a toe portion of the golf club head along the longitudinal direction of the sole. A hitting portion is formed of carbon fiber reinforced resin material and has a substantially triangular shape in cross section, the hitting portion being mounted on the sole and fixed thereto with the rib being fitted within the hitting portion. The sole and the hitting portion constitute a head body, the hitting portion occupying an area of from 70 to 85% of the total area of the cross section of the head body substantially at the longitudinal center of the head body. Also provided is a hosel for receiving a shaft therein and formed of metal material integrally with the sole, the hosel being connected to the sole at the heel portion.

Preferably, the height of the rib is gradually increased from the heel portion toward the toe portion. The rib may be tapered from the lower end to the upper end thereof. More preferably, a front surface of the rib is substantially parallel to a face surface of the hitting portion.

A golf club head of the invention may further comprise a tubular extension formed of carbon fiber reinforced resin material integrally with the hitting portion for covering the entirety of the hosel.

Other objects, features and advantages of the present invention will be apparent from the following detailed description of preferred embodiments thereof when taken in conjunction with the accompanying drawings, in which:

DETAILED DESCRIPTION OF THE INVENTION

Figure 1:
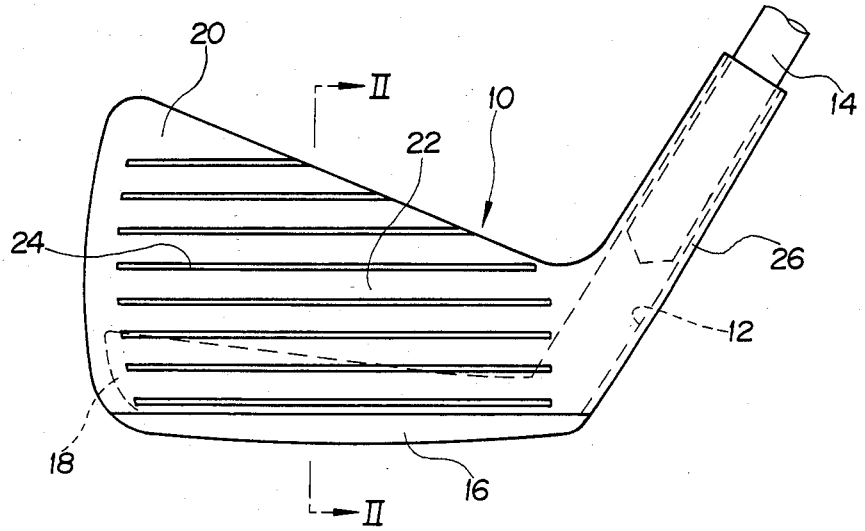
FIG. 1 is a front elevation illustrating a golf club head according to a preferred embodiment of the present invention.
Figure 2:
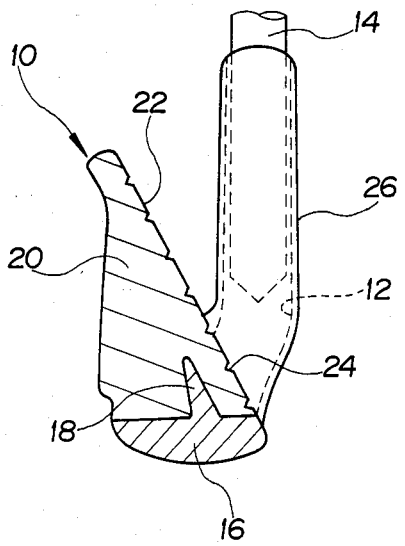
FIG. 2 is a sectional view of the golf club head taken along lines II—II in FIG. 1.

Referring to FIGS. 1 and 2 of the drawings, a golf club head according to a first embodiment is illustrated to have a frontal contour similar to those of conventional iron club heads and comprises a head body 10 and a hosel 12. The hosel 12 is a tubular socket for receiving a shaft 14 therein. The head body 10 includes a sole 16 which is formed of metal material such as soft iron, stainless steel, brass or like material and with which the hosel 12 of metal material is integrally connected at a heel portion of the head body 10. The sole 16 is provided at its upper surface with a rib 18 extending in a longitudinal direction of the sole 16 from the heel portion to a toe portion of the head body 10. In the illustrated embodiment, the rib 18 is located in a front half of the sole 16 and tapers upwardly. As shown in FIG. 1, the height of the rib 18 is gradually increased from the heel portion, at which the rib is integral with the hosel 12, toward the toe portion. The rib 18 is inclined with respect to a phantom line crossed with the sole 16 at a right angle, as shown in FIG. 2, so that the front surface of the rib will be substantially parallel to a face surface described below.

Provided on the sole 16 is a hitting portion 20 which is formed of carbon fiber reinforced resin material and has a substantially triangular shape in cross section to complete in cooperation with the sole 16 the conventional configuration of the head. The hitting portion 20 is a laminated molding of plural sheets of long carbon fiber which is suitably woven and impregnated with thermosetting resin material such as epoxy resin. It is formed into the illustrated shape by heat-hardening the sheets placed on the sole 16 including the rib 18. The portion 20 is fixed to the sole 16 by the intimate contact between the upper surface of the sole 16 and the lower surface of the portion 20 and by the tight fit of the rib 18 in the portion 20. If desired, a suitable adhesive agent may be used to further strengthen the joint between the sole 16 and the portion 20.

The lower marginal edge of the portion 20 is flush with the upper edge of the sole 16. A plurality of grooves 24 are formed on the face surface 22 for imparting spring to a ball to be hit by surface 22. The face surface 22 is substantially parallel to the front surface of the rib 18, thereby to provide a uniform thickness of carbon fiber reinforced resin material therebetween. The rib 18 in the illustrated embodiment has the height of about one-fourth of the height of the portion 20. A tubular extension 26 of carbon fiber reinforced resin material is integrally connected to the hitting portion 20 and covers the entirety of the hosel 12. Thus, in this embodiment the metal material is visual only at the sole 16.

The carbon fiber reinforced resin material forming the hitting portion 20 should occupy an area of 70 to 85% of the total area in the cross section substantially at the longitudinal center of the head body 10, i.e. at the position indicated by lines II—II in FIG. 1. In the embodiment of FIG. 2 the carbon fiber reinforced resin material occupies about 80% and the metal material occupies the reminder. Generally speaking, this ratio in the cross section corresponds to a ratio of the volume of the head body 10.

The hitting portion 20 including the face surface 22 formed of the carbon fiber reinforced resin material has a larger repulsive force and higher elasticity than is obtainable with conventional iron clubs, thereby increasing the hitting distance of a golf ball hit by the club. Further, the face surface 22 is less hard than conventional surfaces and, when hitting the ball, it is somewhat compressed so that its contact area and time of contact with the ball will increase, thus directing the ball in a stable direction. The sole 16 is made of metal as is the case with conventional iron clubs, and hence is not likely to be damaged by pebbles, sand or the like, for example, when hitting a shot from bare ground.

Since the carbon fiber reinforced resin material has a specific gravity less than that of the metal material, the center of gravity of the head is located at a relatively lower part thereof, which is desirable because of easiness in practical use. It should be particularly noted that such location of the center of gravity is achieved without increasing the total weight of the head while maintaining sufficient thickness of the hitting portion 20 at the central area thereof. This increases variety in the design of the head. In this connection, if the metal material is increased to occupy more than 30% based on the total area in the cross section as shown in FIG. 2, the thickness of the hitting area is limited. On the other hand, if the area of the carbon fiber reinforced resin material is increased more than 85% of the total area, either the total weight of the head becomes insufficient, thus resulting in imbalance of the golf club, or the thickness of the head will be too large for achieving a smooth swing. Therefore, the carbon fiber reinforced resin material and the metal material are provided in the ratio from 70:30 to 85:15 in the area as mentioned above.

In the illustrated embodiment, since the hosel 12 on which the largest stress is imposed when hitting a ball is also covered with the carbon fiber reinforced resin material, the hosel 12 is physically strengthened. This permits reduction of the thickness of the metal portion forming the hosel 12 to increase the flexibility between it and the head body for achieving greater hitting distance of the ball.

Although the present invention has been described with reference to preferred embodiments thereof, many modifications and alterations may be made within the spirit of the invention. For example, the sectional shape of the rib 18 is not limited to that illustrated and various shapes such as wedges may be employed for fixing the hitting portion 20 to the sole 16.

What is claimed is:

1. A golf club head of the iron type and comprising:

a sole formed of metal material and defining a lower end portion of the golf club head;

a rib formed on an upper surface of said sole integrally therewith, said rib extending from a heel portion to a toe portion of the golf club head along the longitudinal direction of said sole;

a hitting portion formed of carbon fiber reinforced resin material and having a substantially triangular shape in cross section, said hitting portion being integrally fixed over said sole with said rib being embedded within said hitting portion, lower edges of said hitting portion being coplanar with upper edges of said sole;

said sole and said hitting portion constituting an integral head body, said hitting portion occupying an area of from 70 to 85% of the total area of said head body taken along a transverse cross section substantially at the longitudinal center of said head body; and a hosel for receiving a shaft therein and formed of metal material integrally with said sole, said hosel being connected to said sole at said heel portion.

2. A golf club head as claimed in claim 1, wherein the height of said rib is gradually increased from said heel portion toward said toe portion.

3. A golf club head as claimed in claim 2, wherein said rib is tapered from a lower end to an upper end thereof.

4. A golf club head as claimed in claim 3, wherein a front surface of said rib is substantially parallel to a front face surface of said hitting portion.

5. A golf club head as claimed in claim 1, wherein said rib has the height equal to about one-fourth the height of said hitting portion.

6. A golf club head as claimed in claim 1, further comprising a tubular extension formed of carbon fiber reinforced resin material integrally with said hitting portion, said tubular extension covering the entirety of said hosel.

* * * * *